US007507315B1

(12) United States Patent
Seelenbinder-Apke et al.

(10) Patent No.: US 7,507,315 B1
(45) Date of Patent: Mar. 24, 2009

(54) PAPER MAKING APPARATUS AND METHOD

(76) Inventors: Maxine Seelenbinder-Apke, 3575 Mack Rd., Fairfield, OH (US) 45014-5550; Margaret M. Rhein, 2218 Nicholson Ave., Cincinnati, OH (US) 45211-6117

( * ) Notice: Subject to any disclaimer, the term of this patent is extended or adjusted under 35 U.S.C. 154(b) by 483 days.

(21) Appl. No.: 11/229,973

(22) Filed: Sep. 17, 2005

Related U.S. Application Data

(60) Provisional application No. 60/648,220, filed on Jan. 28, 2005.

(51) Int. Cl.
*D21F 13/02* (2006.01)

(52) U.S. Cl. ..... 162/386; 162/382; 249/113; 249/141

(58) Field of Classification Search ..... 162/219, 162/225, 382, 386, 407, 399; 249/113, 139, 249/141; 264/86, 87; 425/84, 85
See application file for complete search history.

(56) References Cited

U.S. PATENT DOCUMENTS 1,471,169 A * 10/1923 Kaye ..... 162/383
1,995,586 A * 3/1935 Schopper et al. ..... 162/226
3,970,516 A * 7/1976 Barkel et al. ..... 162/382
4,014,739 A * 3/1977 Granberg ..... 162/274
4,462,867 A 7/1984 Fuller
5,351,931 A * 10/1994 Houben et al. ..... 249/141
5,603,808 A 2/1997 Nishikawa
6,860,461 B1 * 3/2005 Otani et al. ..... 249/113

FOREIGN PATENT DOCUMENTS

GB 1511185 * 5/1978

* cited by examiner

*Primary Examiner*—Eric Hug
(74) *Attorney, Agent, or Firm*—Richard S. Erbe

(57) ABSTRACT

A paper making apparatus includes a mould having a mesh screen and a deckle of comparable size. The deckle includes a shaped inner edge for directing pulp onto the screen. The mould and deckle are held together and dipped in a vat having a pulp and water slurry to form a sheet of paper. The mould and deckle are constructed of materials that will not warp, crack, twist, or otherwise deform from repeated use in water. The mould also includes structural ribs to hold its shape. An alternative embodiment of the invention includes a mould having a mesh screen and structural support ribs and a deckle box having a shaped inner lip and a sealing means attached to the lip. The combination of mould and deckle box may be dipped in water and does not require the presence of a vat having a pulp stock. Pulp may be poured into the mould and deckle box assembly. The mould and deckle box are constructed of materials that will not warp, crack, twist, or otherwise deform under normal use in water.

7 Claims, 5 Drawing Sheets

PAPER MAKING APPARATUS AND METHOD

RELATED APPLICATIONS

This application claims the benefit of U.S. Provisional Patent Application No. 60/648,220 filed Jan. 28, 2005 and entitled "Deckle 2-Go," incorporated herein by reference.

BACKGROUND OF THE INVENTION

1. Field of the Invention

The present invention relates to devices and methods for making paper. More particularly, it relates to devices and methods for making individual sheets of paper that may be customized with regard to thickness, design, color, and construction, all in accordance with the preferences of an individual carrying out the methods using exemplary devices in accordance with the present invention.

2. General Background and State of the Art

The art of making individual sheets of paper by an individual has been known for several hundred years. The method which has been most commonly used by individuals to make paper one sheet at a time has included using parts in combination known commonly as the mould, the deckle, and the vat.

To make a sheet of paper using these pieces, the mould and deckle are held together and immersed in the vat. The vat holds the pulp and water mixture, referred to as "stock," from which a sheet of paper is made. The process being described is commonly referred to as "dip forming."

The mould generally is a screen secured by nails or staples to a wooden border. The mould, when immersed in the vat, collects and holds a quantity of pulp from the slurry. The deckle is a removable wooden frame which, in conjunction with the mould, creates the edge of the sheet of paper and also controls the thickness of the sheet of paper.

The mould and deckle are held together by hand and are dipped into the vat holding the pulp, with the plane of the mould and deckle combination perpendicular to the surface of the slurry in the vat. Once immersed in the vat, the mould and deckle are slowly turned, by hand, so that the plane of the mould and deckle is generally parallel to the surface of the stock and the bottom of the vat. A certain quantity of pulp from the stock will settle on the screen of the mould.

The user then lifts the mould and deckle, keeping the mould and deckle level, out of the vat. Once the mould and deckle are clear of the surface of the water, the user moves the mould and deckle (a process known as "stroking") from side-to-side and from front to back, all the while holding the mould and deckle level. Once the mould and deckle have been removed from the vat, water from the slurry is allowed to drain through the mould.

After the desired amount of water has drained, the deckle is removed from the mould and put aside. It is important that deckles of the prior art, because of their wood construction, be carefully rinsed off and then thoroughly dried.

The sheet of pulp remaining on the mould is transferred to a "couching sheet", generally a sheet of woolen felt. After the sheet of paper has been transferred to the couching sheet, the mould can then be rinsed off and dried.

There are a number of problems associated with moulds and deckles of the prior art. As mentioned, in the art of paper making, moulds and deckles of the prior art have been made from wood or hydrophilic material. However, it is well known that wood, especially when exposed repeatedly to moisture, will tend to warp, twist and crack. Thus, known moulds and deckles must be replaced every twelve to eighteen months because of their tendency to warp, twist and crack, because the deformations associated with these prior art devices makes it difficult to control the shape and thickness of a sheet of paper after repeated use of a mould and deckle. The wood from which prior art moulds and deckles are made can be somewhat protected by coating them with a synthetic rubber polymer such as polyurethane, but this only produces more labor for the user and has not been shown to significantly extend the life of prior art moulds and deckles.

Another problem associated with prior art moulds and deckles is that pulp can seep through the area where the mould contacts the deckle, which causes the paper sheet to be uneven and also results in pulp being wasted.

Another problem associated with moulds and deckles of the prior art is that the screen is generally attached to the mould by means of nails and/or staples, which can rust after repeated usage, thus again contributing to the production of uneven sheets of paper and wastage of pulp. Some mould/deckle units have used a metal hinge to join the two—the hinge can also rust after repeated usage, thus resulting in the production of uneven paper sheets and wastage of pulp. Other prior art mould and deckle units were constructed with the screen sewn to the mould. With this and other configurations, excess screen material, such as wire, would collect pulp during the paper making process, thus increasing the cleaning time required. Once solution to that problem was to duct tape the excess screen material to the mould, but duct tape can wear out and come loose and disrupt the paper making process.

Another problem associated with prior art deckles is that many have more than one layer of screen, which resulted in pulp being trapped between them, thus adding to the cleaning and maintenance time required after use.

Thus, there exists the need for a paper making apparatus including a mould and deckle that is constructed from materials that will not normally warp, twist, crack or otherwise deform from repeated exposure to moisture.

There also exists the need for a paper making apparatus including a mould and deckle that is constructed from materials that will be durable and allow the apparatus to be used continuously over many years and will not require frequent replacement.

There also exists the need for a paper making apparatus including a mould and deckle that will provide a way to dependably and repeatedly make even sheets of paper and will not allow for the wasting of pulp.

There further exists the need for a paper making apparatus including a mould and deckle that is does not require the user to spend excessive amounts of time rinsing, cleaning and drying the apparatus.

Yet another need exists for a paper making apparatus including a mould and deckle that does not require any additional and repeated applications of protective coatings to extend the life of the apparatus.

There also exists a need for a paper making apparatus including a mould and deckle that can be used without the requirement of a vat.

Yet a further need exists for a paper making device including a mould and deckle that can be used for storage for paper making materials, such as felt sheets, bottles, sponges and inclusions.

Still another need exists for a paper making apparatus including a mould and deckle that allows the use of different colors, pulps and inclusions without having to engage in extensive cleaning or preparation steps between making sheets of paper.

None of the prior art devices for making paper address these needs and provides the advantages of the present invention.

SUMMARY OF THE INVENTION

The disadvantages of prior art paper making devices are overcome by the present invention, which, in a broad aspect, provides the user with a durable paper making apparatus including a mould and deckle that will not deform with repeated use and will provide the user with the ability to consistently and repeatedly make paper sheets of a uniform thickness and shape, without causing wastage of pulp used for making the sheets of paper, nor requiring any labor intensive steps outside of the actual paper making process.

The present invention includes a mould constructed of a screen made from a durable polymer such as heat shrunk polypropylene or woven wire. In the preferred embodiment of the invention, the screen is attached by an epoxy compound to a frame made of a durable plastic. A plurality of support ribs, also constructed of a durable plastic, is mounted between opposing sides of the frame. A mould constructed in accordance with the paper making apparatus of the present invention will not warp, crack, twist or otherwise deform even while repeatedly exposed to water. There are no metal fasteners used with the present invention that can rust from exposure to water. The addition of support ribs ensures that the mould will hold to its shape over many years and provides structural support for the mould during the paper making process.

The apparatus according to the present invention also includes a frame or "deckle" made of durable plastic for use with the mould just described. The deckle of the present invention also includes a shaped inner edge which forms the edges of the paper sheet and helps to collect the pulp when the mould and deckle combination are placed in the vat containing the pulp. Because of the construction of the deckle of the present invention, it will not warp, crack, twist or otherwise deform from repeated or continuous exposure to water.

The mould and deckle of the present invention are used together in much the same way as the prior art mould and deckle are used to make a sheet of paper. With the mould and deckle constructed in accordance with the present invention however, the user can repeatedly expect to produce sheets of paper having a uniform thickness with a consistent edge. Because the mould and deckle of the present invention will not deform because of repeated exposure to water, leakage of pulp is minimized or eliminated, thus maximizing the use of the pulp in the vat. After the mould and deckle of the present invention have been used to make a sheet of paper, they may simply be rinsed off and allowed to air dry without requiring any time-consuming rinsing and drying, as with the prior art mould and deckle.

The mould and deckle of the present invention require no protective coatings and should endure for many years. The mould and deckle of the present invention will not require repeated replacement and thus, over time, the costs associated with using a paper making apparatus according to the present invention will be less than that of the traditional prior art paper making devices.

In another embodiment of the present invention, a mould constructed in accordance with the present invention is used in connection with a an enclosure or "deckle box" to make sheets of paper. The deckle box is constructed of a durable plastic and, preferably, is formed in a rectangular shape consisting of four walls that are sized to fit closely over the mould. However, the present invention could be constructed in other shapes as well, such as spherical, for example. The inner surface of the deckle box of the present invention includes an angled lip and drop mounted along its inner surface between the top and bottom of the deckle box. The angled lip directs pulp onto the mould screen during the paper making process. The drop is a straight portion on the lower part of the lip that may be varied in size depending on the size paper that is desired.

Mounted on the lower surface of the angled lip of the deckle box is a sealing means, preferably in the form of a foam barrier, which abuts the mould during the paper making process and forms a tight seal between the deckle box and the frame, virtually eliminating the possibility of leakage of pulp from between the mould and the deckle box during the paper making process.

This embodiment of the invention also includes a plurality of pegs to secure the mould and the deckle box together by means of inserting the pegs through aligned holes in the deckle box and the mould. Thus, during the paper making process, it is not necessary for the user to tightly hold the deckle box and mould together, as is necessary with the traditional mould and deckle.

The deckle box in accordance with this embodiment of the invention may also include openings in the side walls to serve as handholds, which allows the assembled mould and deckle box to be easily manipulated as a unit by the user during the paper making process.

A distinctive advantage of the deckle box and mould of the alternative embodiment of the invention over the traditional mould and deckle is that there is no requirement for a vat; the deckle box can serve that function. To make a sheet of paper using the mould and deckle box in accordance with the alternative embodiment of the present invention, the deckle box is first placed over the mould until the sealing means on the angled lip abuts the mould. The securing pegs are inserted through their respective holes in the deckle box and mould, securing the mould and deckle box together.

The mould/deckle box combination is then placed on the bottom of a pan of water, which should be deep enough so that water covers the mould screen and the angled lip of the deckle box. A pulp stock is then poured into the deckle box and is directed onto the mould screen by the angled lip. While this step is in progress, the user does not have to touch the mould/deckle box combination, as the user would have to do using the traditional mould and deckle.

After the pulp has been allowed to be distributed, the mould/deckle box combination is slowly lifted out of the water pan, while the user performs the stroking operation that is performed using the traditional mould and deckle. The mould/deckle box combination may be lifted from the water by the user by either placing the hands underneath the deckle box or using the openings in the side walls of the deckle box.

Once the mould/deckle box combination has been lifted out of the water pan; the water in the mould/deckle box is allowed to drain. Once the water has been drained, the user may examine the sheet on the screen, and if he or she is not pleased with the appearance or thickness of the sheet, the mould/deckle box may be placed back into the water. The pulp will rise from the screen and the user may swish the mould/deckle box around and start the process over. Thus, this embodiment of the invention offers another distinctive advantage over traditional moulds and deckles by allowing the user to correct errors or to improve upon the product immediately without wasting pulp.

Once the user is satisfied with the sheet of paper that is on the screen, the mould/deckle box is drained and placed on a flat surface. The securing pegs are removed and the deckle box is lifted off the mould. From this point on, the sheet of paper is couched as was previously described. The mould and deckle box are then washed off with water and either allowed to air dry, or they can be used again to make another sheet of paper. Another advantage of this alternative embodiment of the invention is that the mould and deckle box can be used with different types and colors of pulp in consecutive uses, because there is no requirement for a vat.

The deckle box constructed in accordance with the alternative embodiment of the present invention should not warp, crack, twist or otherwise deform due to repeated exposure to water and will probably last for many years, unlike traditional prior art paper deckles.

The deckle box and mould constructed in accordance with the alternative embodiment of the invention may be used to store paper making materials.

The deckle box and mould constructed in accordance with the present invention allows the user to make thicker sheets of paper than with prior art moulds and deckles.

Further objects and advantages of this invention will become more apparent from the following description of the preferred embodiments, which, taken in conjunction with the accompanying drawings, will illustrate, by way of example, the principles of the invention.

BRIEF DESCRIPTION OF THE DRAWINGS

The foregoing and other objects, aspects and advantages will be better understood from the following detailed description of the preferred embodiments of the invention with reference to the drawings in which.

DETAILED DESCRIPTION OF THE PREFERRED EMBODIMENTS OF THE INVENTION

In the following description of the invention, reference is made to the accompanying drawings, which form a part thereof, and in which are shown, by way of illustration, exemplary embodiments illustrating the principles of the present invention and how it may be practiced. It is to be understood that other embodiments may be utilized to practice the present invention, and structural and functional changes may be made thereto without departing from the scope of the present invention.

Figure 1:
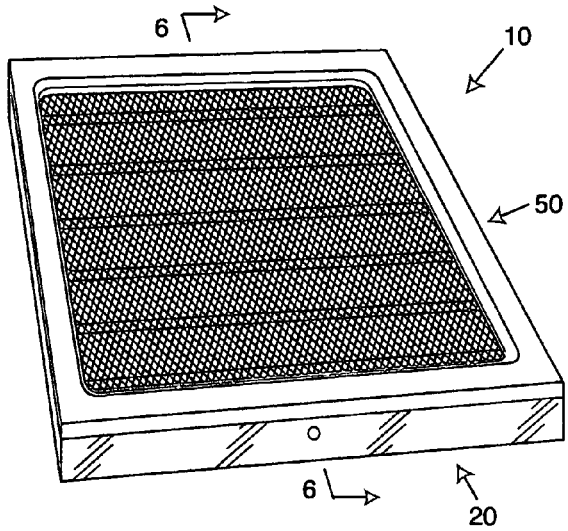
FIG. 1 illustrates a perspective view of an exemplary paper making apparatus according to the present invention, with a deckle mounted on top of a mould.
Figure 2:
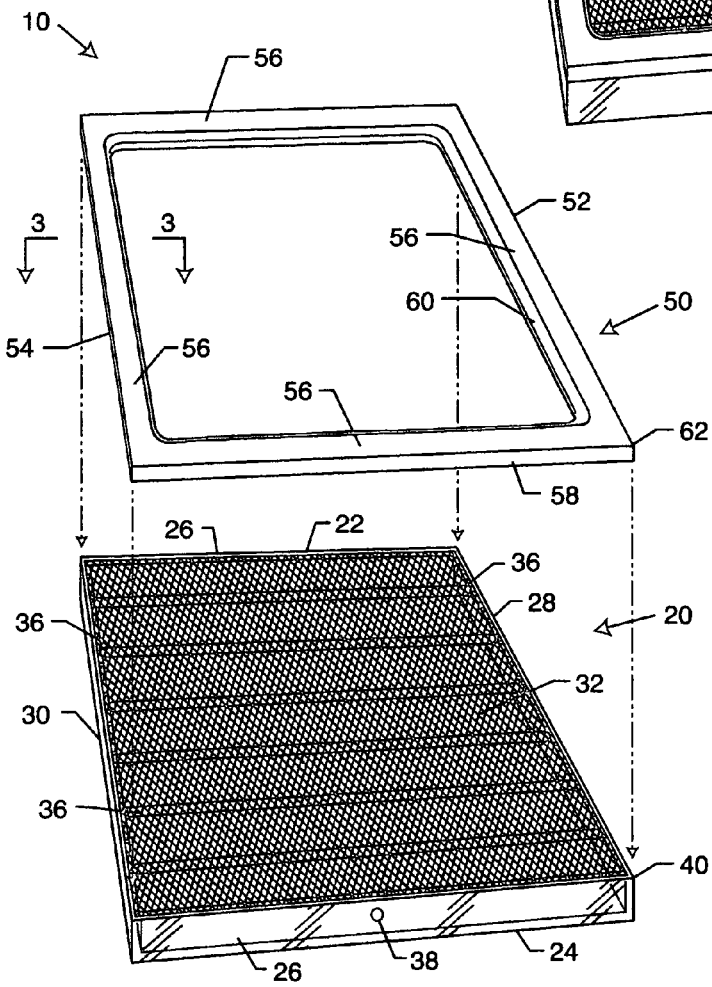
FIG. 2 illustrates an exploded view of an exemplary paper making apparatus according to the present invention, with the deckle separated from the mould.

A preferred embodiment of a paper making apparatus according to the present invention is illustrated in FIGS. 1-7 and is generally referred to by the reference numeral 10. The paper making apparatus 10 includes two main components, mould 20 and deckle 50, as illustrated in FIG. 1.

Figure 3:
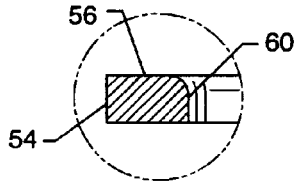
FIG. 3 illustrates a sectional view taken along line 3-3 in FIG. 2.
Figure 4:
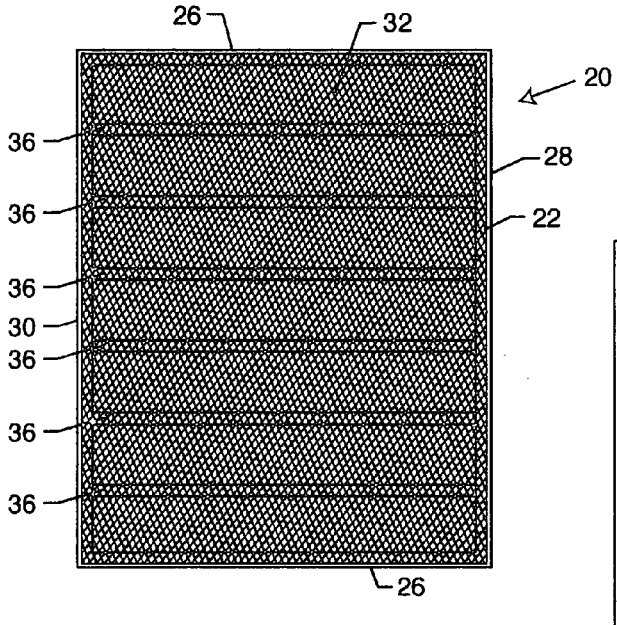
FIG. 4 illustrates a plan view of the mould for use with an exemplary paper making apparatus according to the present invention.
Figure 5:
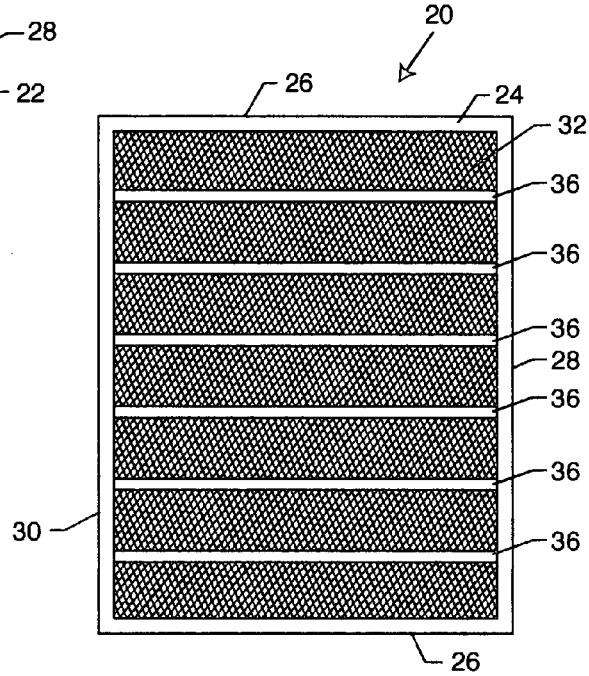
FIG. 5 illustrates bottom view of the mould for use with an exemplary paper making apparatus according to the present invention.
Figure 6:
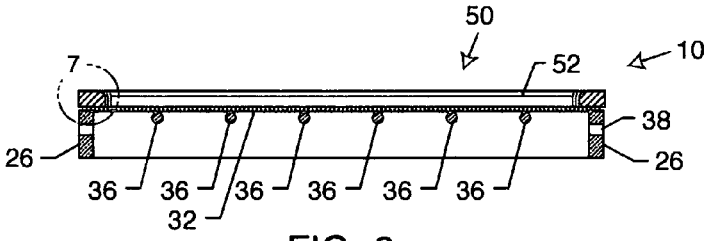
FIG. 6 illustrates a cross sectional view taken at line 6-6 in FIG. 1.
Figure 7:
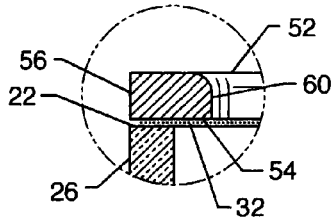
FIG. 7 illustrates a sectional view taken at circle 7 in FIG. 6.
Figure 8:
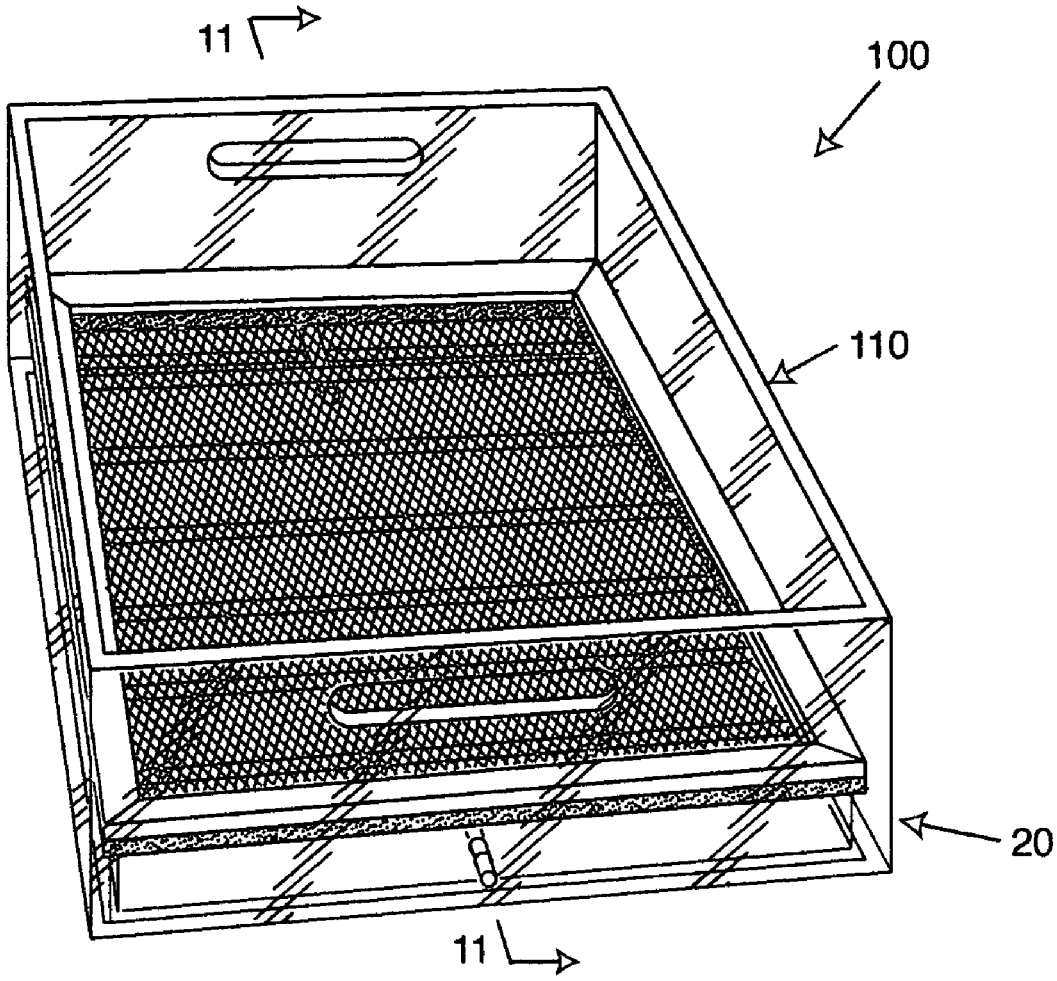
FIG. 8 illustrates a perspective view of a second embodiment of an exemplary paper making according to the present invention, showing a deckle box mounted on top of a mould.
Figure 9:
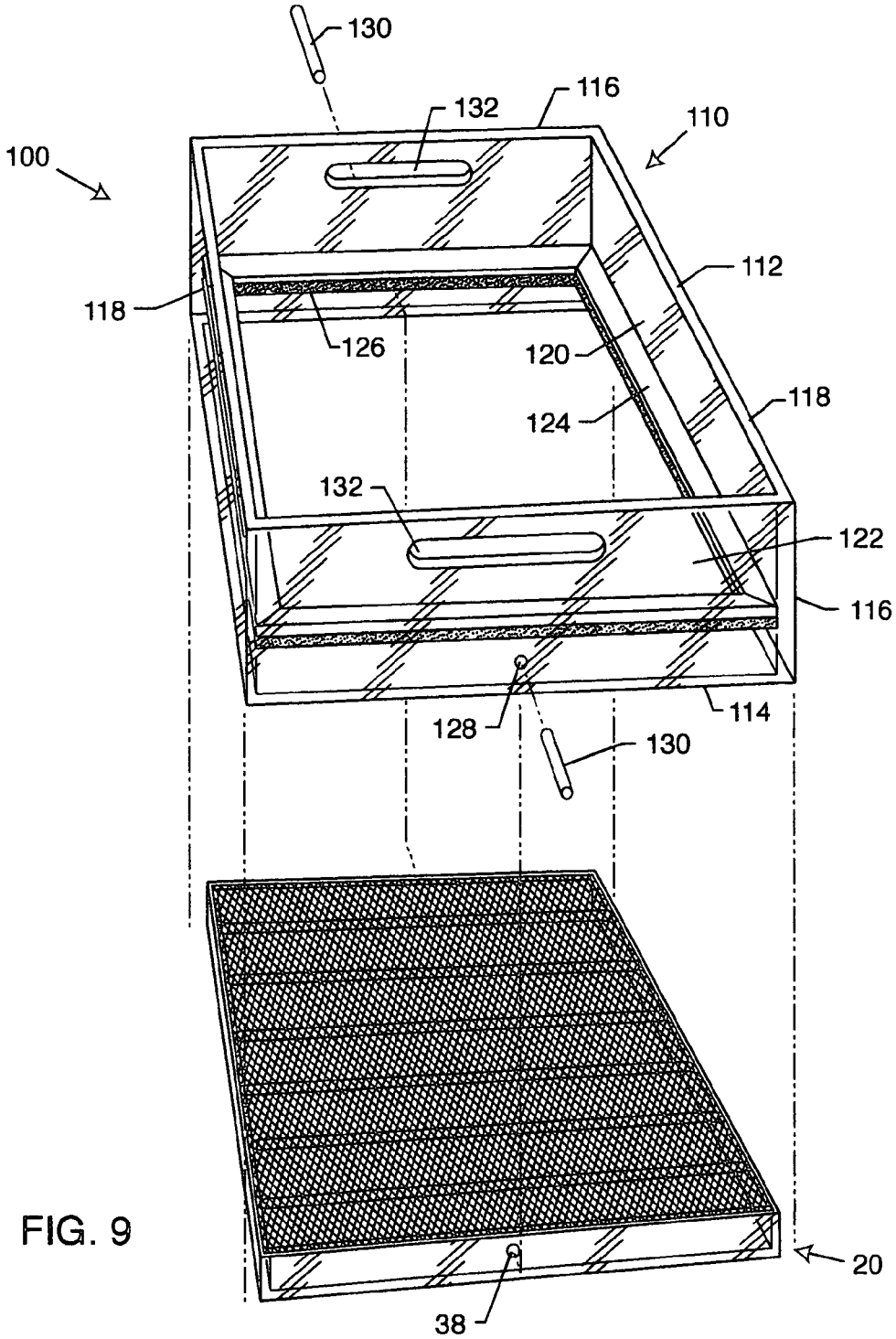
FIG. 9 illustrates an exploded view of a second embodiment of an exemplary paper making according to the present invention.
Figure 10:
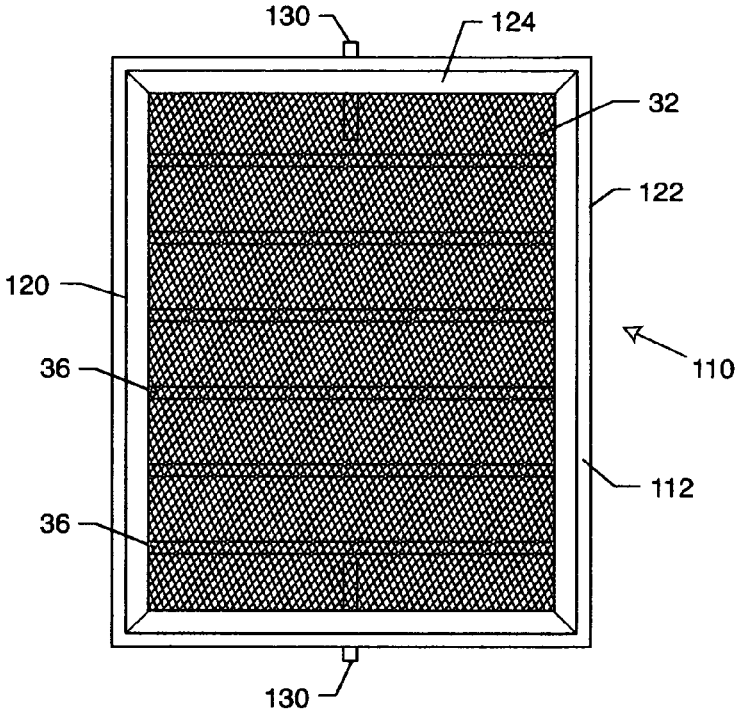
FIG. 10 illustrates a plan view of a second embodiment of an exemplary paper making according to the present invention.

FIGS. 2-7 illustrate the more detailed construction of mould 20 and deckle 50. Deckle 50 forms the frame that gives the sheet of paper its borders. Deckle 50 includes a periphery 62 that is defined by four frame elements 56 and includes top 52 and bottom 54. During the paper making process, bottom 54 is in contact with mould 20. Outer edge 58 defines the outer dimensions of deckle 50 and is generally of the same outer dimensions as mould 20. The inner edge 60 of deckle 50 is constructed with a curve, as best illustrated in FIGS. 3 and 7, which forms the edges of the paper sheet and helps to collect the pulp when the mould and deckle combination are placed in the vat containing the pulp during the paper making process. Deckle 50 is constructed of a durable plastic, such as polyethylene, polycondensates, synthetic polymers, thermoplastics, fiber filled polymers, and hydrophobic polymers, so that it will not crack, warp or twist due to repeated use in water.

Mould 20 provides a mesh screen 32 where pulp is collected during the paper making process. In the preferred embodiment of the invention, screen 32 is a mesh screen constructed of a durable polymer such as heat shrunk polypropylene, with a screen construction of thirty openings per inch, although the screen 32 may be constructed within a range of ten to forty openings per inch, depending on the stock and the desired product. The polypropylene elements are preferably between ten to twenty mils in thickness.

Screen 32 is attached to the upper surface 22 of mould 20, by an adhesive or epoxy. Mould 20 has a periphery 40 that is formed by top wall 28, bottom wall 30, and two side walls 26. The reference to a top wall 28, bottom wall 30, and side walls 26 is determined by the relative position of the walls of mould 20 when it is being used in the paper-making process; top wall 28 is positioned above bottom wall 30 when the dip forming process begins and when the steps of removing the sheet of paper are initiated.

Mould 20 also includes a plurality of support ribs 36 extending between top wall 28 and bottom wall 30 (although they could be extended between the side walls 26) beneath mesh screen 32. Support ribs 36 serve the purpose of providing structural strength to mould 20 when pressure is applied to the mould during the paper making process, and also to help maintain the shape of mould 20. It is important to note that screen 32 and support ribs 36, in normal use, are not in contact with each other, so that there is no chance of stock being trapped between the two during the paper making process. Top wall 28, bottom wall 30, side walls 26 and support ribs 36 are all constructed of a durable plastic, so that mould 20 is resistant to cracking, warping or twisting from repeated use in water. The process of making paper sheets using mould 20 and deckle 50 have been described earlier.

FIGS. 8-12 illustrate an alternative embodiment of the invention, generally indicated by the numeral 100. This alternative embodiment of the invention uses the same mould 20 as in the preferred embodiment of the invention already described. In this alternative embodiment of the invention, a deckle box 110 is used in conjunction with mould 20 to make paper and provides a number of advantages over prior art moulds and deckles.

FIGS. 9-12 illustrate the construction of deckle box 110, which is constructed of a durable plastic, such as polyethylene, polycondensates, synthetic polymers, thermoplastics, fiber filled polymers, and hydrophobic polymers. Deckle box 110 is formed by two short members 116 and two long members 118 to form a rectangular box-like enclosure. The dimensions of members 116 and 118 are selected so when deckle box 110 is placed over mould 20 during the paper making process, the deckle box 110 and mould 20 will form a tight fit. Of course, other shapes for deckle box 110 are possible, such as round, ovular, elliptical, triangular, and other forms of polygons, cubical, spherical, or cylindrical, depending on the preferences of the user and the product being made.

Figure 11A:
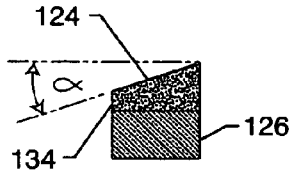
FIG. 11A illustrates a sectional view taken at circle 11A of FIG. 11.
Figure 11:
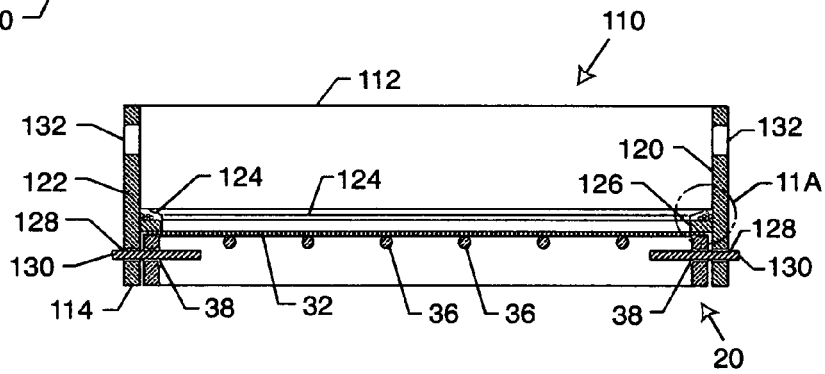
FIG. 11 illustrates a sectional view taken along line 11-11 of FIG. 8.
Figure 12:
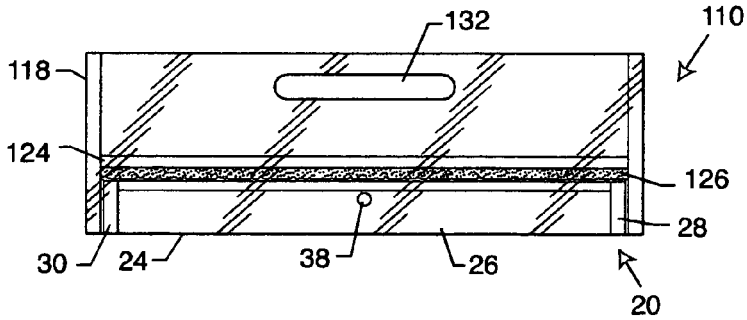
FIG. 12 illustrates an end view of a second embodiment of an exemplary paper making according to the present invention.

Deckle box 110 includes an outer surface 122 and an inner surface 120. Mounted on inner surface 120 is an angled lip 124, which extends along the inner surface along members 116 and 118 between top 112 and bottom 114 of deckle box 110. The purpose of angled lip 124 is to shape the edges of the paper and to guide pulp from which the paper is made onto mesh screen 32 of mould 20. In this embodiment of the invention, angle $\alpha$ (as shown in FIG. 11A) is preferably at 45° from the horizontal, although the angle may vary between 20° and 70°.

Angled lip 124 also includes drop 134, a vertical portion that may vary in size depending on the thickness of the paper desired. The configuration of angled lip 124 with drop 134 provides a distinctive advantage to this embodiment of the invention over other paper making devices, as prior devices generally included a straight, sharp edge to frame and guide the stock. Such straight edges are sharp and tend to chip, are a safety hazard, and may disrupt the paper making process.

Located on the lower side (the side closest to bottom 114) of angled lip 124 is a foam seal 126. The purpose of seal 126 is to minimize leakage of pulp between deckle box 110 and mould 20 during the paper making process. Seal 126 is preferably made of a compressible urethane foam, such as Poron9, which may be obtained from Hunter Corporation of Bethel Park, Pa. Angle lip 124 and seal 126 are located on inner surface 120 at a location so that when deckle box 110 is placed over mould 20, seal 126 contacts upper surface 22 of mould 20 to form a tight seal. It is also desirable that in this position, bottom 114 of deckle box 110 is at the same level as lower surface 24 of mould 20.

Deckle box 110 also includes a pair of hand holds 128 in short members 116 for use during the paper making process. Deckle box 110 also includes a pair of opposed openings 128, which correspond to openings 38 in mould 20. When using deckle box 110 in conjunction with mould 20 to make paper, a pair of securing pegs 130 are inserted into each of the corresponding openings 128 and 38 to secure deckle box 110 to mould 20.

Method of Making Paper Using the Mould and Deckle Box. To make a sheet of paper using the mould 20 and deckle box 110, the deckle box 110 is placed over mould 20 so that the seal 126 contacts the upper surface 22 of the mould 20. Securing pegs 130 are then inserted through openings 128 in deckle box 110 and corresponding openings 38 in mould 20. This method of making paper does not require a vat, as prior art moulds and deckles require.

The assembled mould 20 and deckle box 110 is placed in a pan of water. The pan should be sized so that it can accommodate the outer dimensions of deckle box 110. There should be sufficient water in the pan so that it at least covers mesh screen 32, and preferably angled lip 124. The depth of the water in the pan is important; the deeper the water, the greater the disbursement of pulp fibers.

After the mould/deckle box assembly has been placed in the pan of water, a pre-prepared slurry of pulp and water is poured into the assembly onto mesh screen 32. Angled lip 124 directs the slurry onto the mesh screen 32. The stock is preferably mixed in a ratio of one part pulp to six to eight parts of water. The pulp then begins to align on the screen 32 to form a sheet of paper. The more time that the mould/deckle box assembly is left in the water, the more the pulp will "lock in" or align to form a sheet of paper.

The user then either grasps the hand holds 132 or the bottom 114 of deckle box 110 moves the mould/deckle box assembly horizontally to evenly spread out the pulp on the mesh screen 32. This motion continues while the mould/deckle box assembly is lifted out of the container of water.

Once the mould 20 and deckle box 110 have been removed from the pan of water, they are placed on a level surface and any water remaining in the mould/deckle box assembly is allowed to drain. After the water has drained, securing pegs 130 are removed from deckle box 110 and mould 20. Deckle box 110 is lifted from mould 20, rinsed with water and set aside to dry.

Mould 20 holding the sheet of paper is then placed in contact with a "couching sheet," generally a sheet of woolen felt, and removed from mould 20. The process of removing a sheet of paper from a mould is generally known in the art and will not be described in further detail.

One advantage of the making a sheet of paper using the mould 20 and deckle box 110 according to the present invention is that when the user lifts the mould 20 and deckle box 110 from the water, he or she may examine the sheet of paper on mesh screen 32 for thickness and form. If the sheet of paper is not satisfactory, the user simply replaces the pegs and places the mould 20 and deckle box 110 back into the container of water. The pulp on screen 32 will rise, and the user can allow the pulp to align again and lock in. The user then lifts the mould 20 and deckle box 110 from the water. If the sheet of paper is satisfactory to the user, the user then performs the steps of draining the water, removing deckle box 110 from mold 20, and removing the sheet of paper from mould 20. Thus, the method of making paper using the mould 20 and deckle box 110 combination in accordance with the alternative embodiment of the invention allows the user some flexibility and a way to correct errors that are not known in prior art methods of making paper.

Potential uses for paper created with the devices and methods described herein include, but are not limited to, the following.

Greeting cards of all types.
Drawing paper.
Gift tags.
Invitations.
Invitations.
Birth announcements.
Wrapping paper.
Christmas tree ornaments.
Decorative table settings.
Printmaking.
Stationary.
Calligraphy.
Book binding.

Luminaries and lamp shades.
Paper lanterns.
Bowls and plates.
Paper mache'
Screens and shades for windows.
Portfolio pages.
Stamp art.
Box making.
Matting and framing.
Photo backdrops.
Frames.
Jewelry.
Embossing.
Book covers and end papers.
Collage.
Business cards.
Covering boxes.
Wallpaper.

The foregoing description of the exemplary embodiments of the present invention have been presented for purposes of enablement, illustration, and description. It is not intended to be exhaustive of or to limit the present invention to the precise form discussed. There are, however, other configurations for paper making devices not specifically described herein, but with which the present invention is applicable. The present invention should therefore not be seen as limited to the particular embodiment described herein; rather, it should be understood that the present invention has wide applicability with respect to paper-making devices. Such other configurations can be achieved by those skilled in the art in view of the description herein. Accordingly, the scope of the invention is defined by the following claims.

What is claimed is:

1. A paper making apparatus comprising:

a mould having an upper surface and a lower surface, said mould formed by a plurality of walls, and a mesh screen adhered to the upper surface;

an enclosure for placing on the mould, said enclosure formed by plurality of members, the enclosure having a top and bottom, an inner surface and an outer surface;

an angled lip disposed on the inner surface of the enclosure between the top and bottom of the enclosure; and a sealing means disposed on the inner surface of the enclosure adjacent said angled lip between the angled lip and the bottom of the enclosure, whereby, during the process of making paper, the enclosure is placed over the mould with the sealing means contacting the upper surface of the mould.

2. The apparatus according to claim 1, wherein said mould includes a plurality of structural ribs extending between two of said walls.

3. The apparatus according to claim 1, wherein the openings in said screen are in the range of ten to forty holes per inch.

4. The apparatus according to claim 1, further comprising:

an opening in each of two opposed walls of said mould;

an opening in each of two opposed members of said enclosure, wherein each of said openings in the members will be in alignment with one of the openings in the walls when the enclosure is placed on the mould; and a pair of securing pegs, each peg configured for insertion through a hole of the enclosure and a hole of the mould.

5. The apparatus according to claim 1, wherein said mould and said enclosure are constructed of a durable plastic.

6. The apparatus according to claim 1, wherein said angled lip forms an angle between twenty and seventy degrees from horizontal.

7. The apparatus according to claim 2, further comprising a cut-out forming a hand hold in two opposed members of said enclosure.

* * * * *